US008026434B2

(12) United States Patent
Luo

(10) Patent No.: US 8,026,434 B2
(45) Date of Patent: Sep. 27, 2011

(54) MUSICAL INSTRUMENT PEDAL

(75) Inventor: Ying-Chin Luo, Lu Chou (TW)

(73) Assignee: K.H.S. Musical Instrument Co., Ltd., Lu Chou, Taipei Hsien (TW)

( * ) Notice: Subject to any disclaimer, the term of this patent is extended or adjusted under 35 U.S.C. 154(b) by 0 days.

(21) Appl. No.: 12/655,161

(22) Filed: Dec. 23, 2009

(65) Prior Publication Data

US 2011/0146475 A1 Jun. 23, 2011

(51) Int. Cl.
*G10D 13/02* (2006.01)

(52) U.S. Cl. ..... 84/422.1

(58) Field of Classification Search ..... 84/422.1
See application file for complete search history.

(56) References Cited

U.S. PATENT DOCUMENTS 5,297,467 A * 3/1994 Hoshino ..... 84/422.1
5,343,792 A * 9/1994 Liao ..... 84/422.1
5,388,494 A * 2/1995 Hoshino ..... 84/422.1
5,398,584 A * 3/1995 Liao ..... 84/422.1
5,567,899 A * 10/1996 Hoshino ..... 84/422.1
5,659,144 A * 8/1997 Shigenaga ..... 84/422.1
5,714,701 A * 2/1998 Hsieh ..... 84/422.1
6,222,108 B1 * 4/2001 Liao ..... 84/422.1
7,405,352 B2 * 7/2008 Dorfman et al. ..... 84/422.1
7,579,540 B2 * 8/2009 Takegawa ..... 84/422.1
7,671,262 B1 * 3/2010 Lin ..... 84/422.1
7,812,237 B1 * 10/2010 Dunnett ..... 84/422.1
7,855,331 B1 * 12/2010 Chen ..... 84/422.1
7,956,268 B1 * 6/2011 Liao ..... 84/422.1
2007/0113722 A1 * 5/2007 Chen ..... 84/422.1
2011/0146474 A1 * 6/2011 Luo ..... 84/422.1
2011/0146475 A1 * 6/2011 Luo ..... 84/422.1

* cited by examiner

*Primary Examiner* — Elvin G Enad
*Assistant Examiner* — Robert W Horn
(74) *Attorney, Agent, or Firm* — Charles E. Baxley

(57) ABSTRACT

A musical instrument pedal has a base, two supporting posts, a pedal plate, a shaft, an elevation-angle-adjusting assembly, a chain assembly and two beaters. The pedal plate is mounted pivotally on the base. The shaft is mounted rotatably between the supporting posts. The elevation-angle-adjusting assembly is mounted on the shaft and selectively changes an angle thereof relative to the shaft. The chain assembly connects the pedal plate to the shaft. The beaters are mounted on the shaft. The elevation-angle-adjusting assembly allows users to quickly change an elevation angle of the pedal plate.

7 Claims, 8 Drawing Sheets

MUSICAL INSTRUMENT PEDAL

BACKGROUND OF THE INVENTION

1. Field of the Invention

The present invention relates to a pedal, and more particularly to a musical instrument pedal that is applied to percussion instruments and quickly varies an elevation angle of a pedal plate thereof.

2. Description of Related Art

Percussion instruments such as crash cymbals, tom-toms, snare drums and bass drums are commonly used in performances. For example, a bass drum is set under the ground near a player's feet and a drum pedal is connected to the bass drum and has a beater selectively driven by the player to strike the bass drum to play music.

A conventional drum pedal comprises a base, two posts, a pedal plate, two shafts, a crossbeam, two beaters, a chain and two positioning devices. The posts are mounted uprightly on the base. The pedal plate is mounted on the base between the posts and has a rear end mounted pivotally on the base and a fore end lifted up. The shafts are transversely and rotatably mounted respectively on the posts. The crossbeam is mounted securely between and reinforces the posts. The beaters are pivotally mounted respectively on the shafts and each beater has a striking head capable of striking a bass drum. The chain has two ends, one end is mounted securely on one shaft and the other end is mounted on the fore end of the pedal plate so that pivoting the pedal plate drives one beater to strike. The positioning devices are mounted respectively on the posts and are connected respectively to the shafts and provide resilient forces to recover the shafts to a specific angle relative to the base when no external forces are applied to the shafts.

However, a predetermined elevation angle of the pedal plate is invariable and may not be suitable for different users with different stepping habits. For example, a user usually used to a high elevation angle of the pedal plate easily steps the pedal plate with a standard elevation angle over deeply to inadvertently make an over heavy strike on the bass drum. Alternatively, a user used to a low elevation angle of the pedal plate likely steps the pedal plate with the standard elevation angle over shallowly to accidentally make over light strike.

To overcome the shortcomings, the present invention provides a musical instrument pedal to mitigate or obviate the aforementioned problems.

SUMMARY OF THE INVENTION

The main objective of the invention is to provide a musical instrument pedal that is applied to percussion instruments and quickly varies an elevation angle of a pedal plate thereof.

A musical instrument pedal in accordance with the present invention has a base, two supporting posts, a pedal plate, a shaft, an elevation-angle-adjusting assembly, a chain assembly and two beaters. The pedal plate is mounted pivotally on the base. The shaft is mounted rotatably between the supporting posts. The elevation-angle-adjusting assembly is mounted on the shaft and selectively changes an angle thereof relative to the shaft. The chain assembly connects the pedal plate to the shaft. The beaters are mounted on the shaft. The elevation-angle-adjusting assembly allows users to quickly change an elevation angle of the pedal plate.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
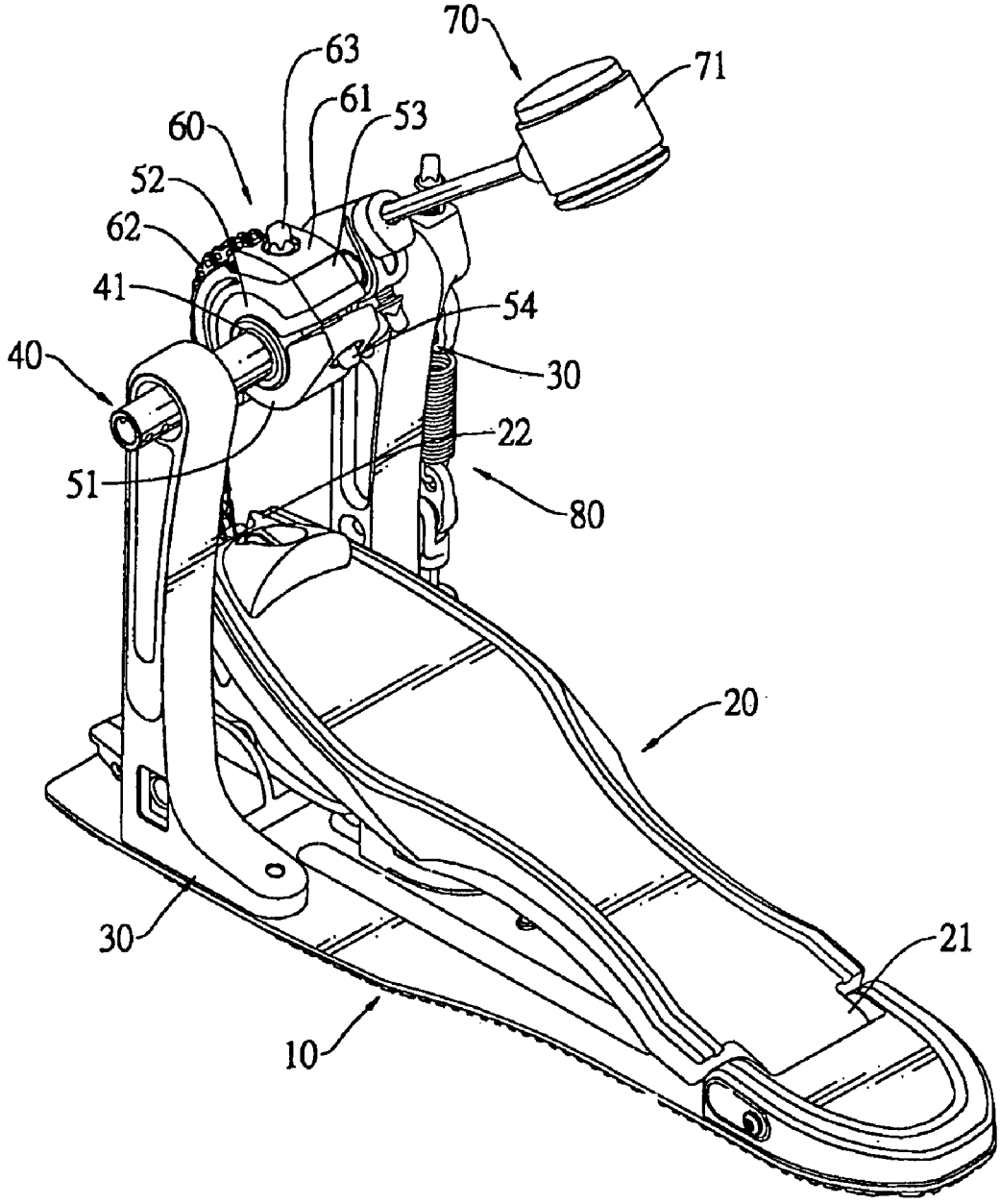
FIG. 1 is a front perspective view of a musical instrument pedal in accordance with the present invention.
Figure 2:
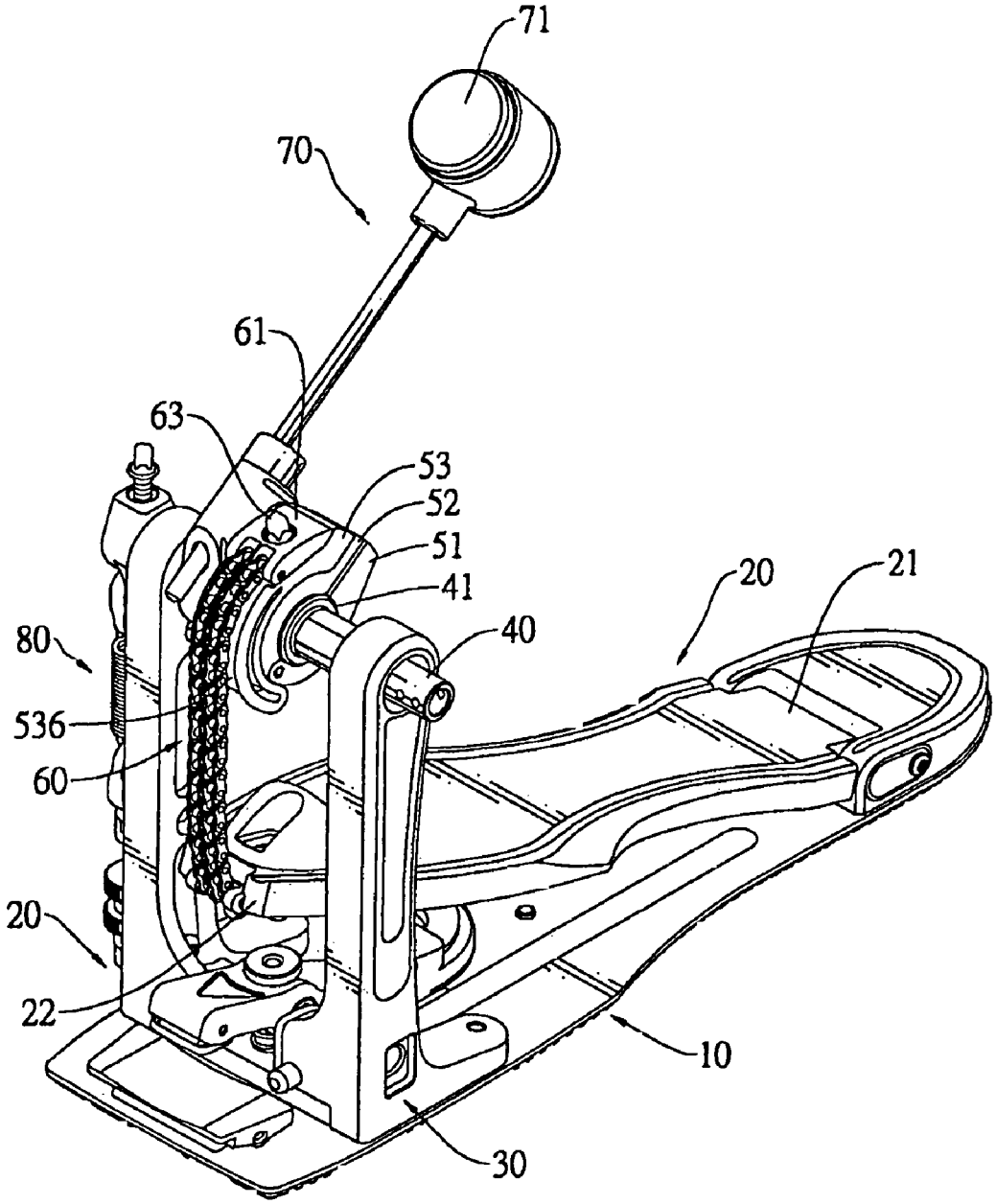
FIG. 2 is a rear perspective view of the musical instrument pedal in FIG. 1.
Figure 3:
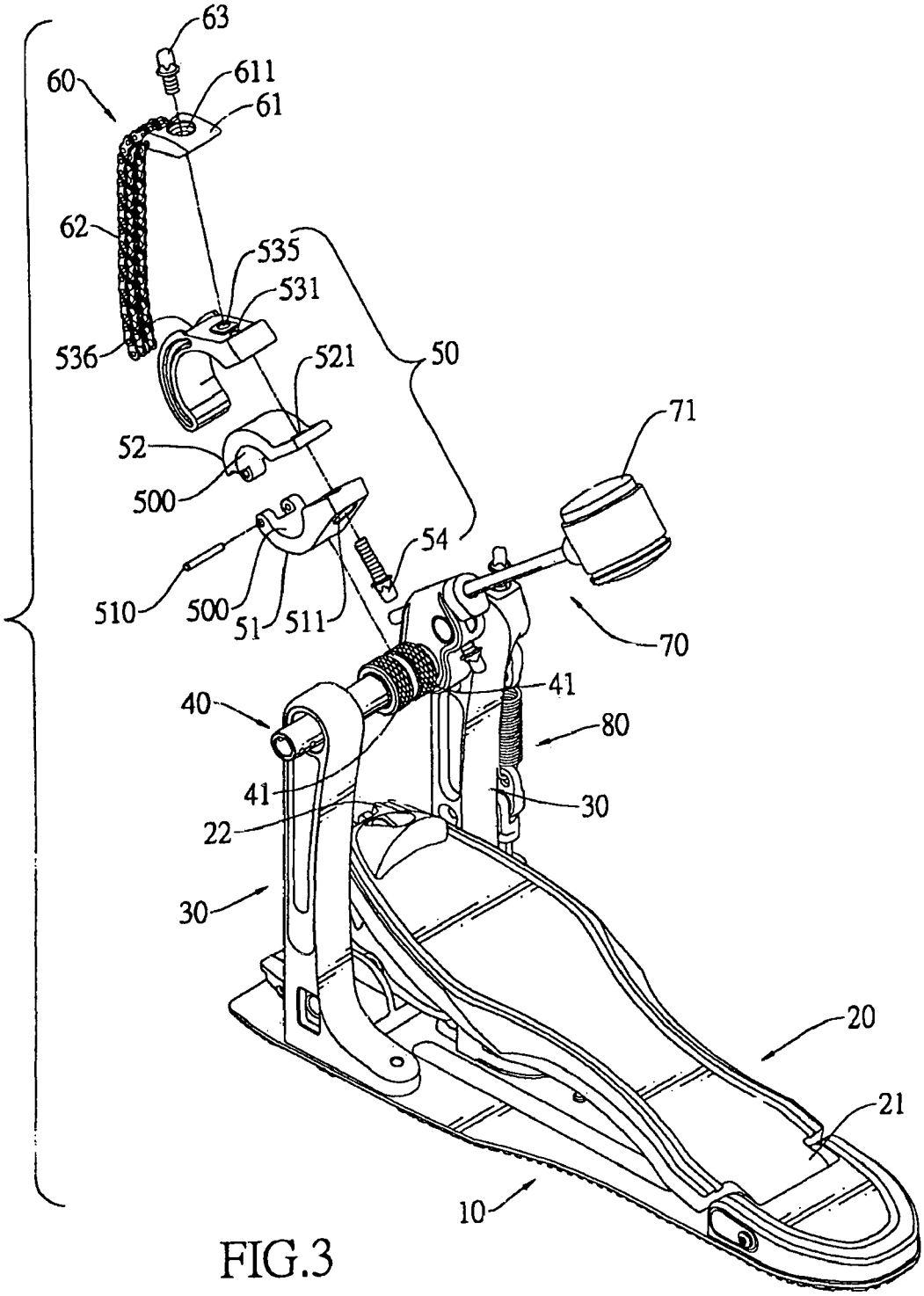
FIG. 3 is a partially exploded perspective view of the musical instrument pedal in FIG. 2.

With reference to FIGS. 1 to 3, a musical instrument pedal in accordance with the present invention may be used for percussion instruments such as but not limited to bass drums. The musical instrument pedal comprises a base (10), two supporting posts (30), a pedal plate (20), a shaft (40), an elevation-angle-adjusting assembly (50), a chain assembly (60) and two beaters (70) and may further have at least one positioning assembly (80).

The base (10) is flat.

The supporting posts (30) are mounted uprightly on the base (10).

The pedal plate (20) is mounted on the base (10) between the supporting posts (30) and has a rear end (21) and a fore end (22). The rear end (21) is mounted pivotally on the base (10). The fore end (22) is defined opposite to the rear end (21) and is lifted over the base (10).

The shaft (40) is mounted rotatably on and between the supporting rods and has at least one friction ring (41). The at least one friction ring (41) is mounted securely around the shaft (40). Each of the at least one friction ring (41) may have an outer surface and a friction texture formed on the outer surface to increase the friction between the at least one friction ring (41) and a clamping element clamping the at least one friction ring (41).

Figure 4:
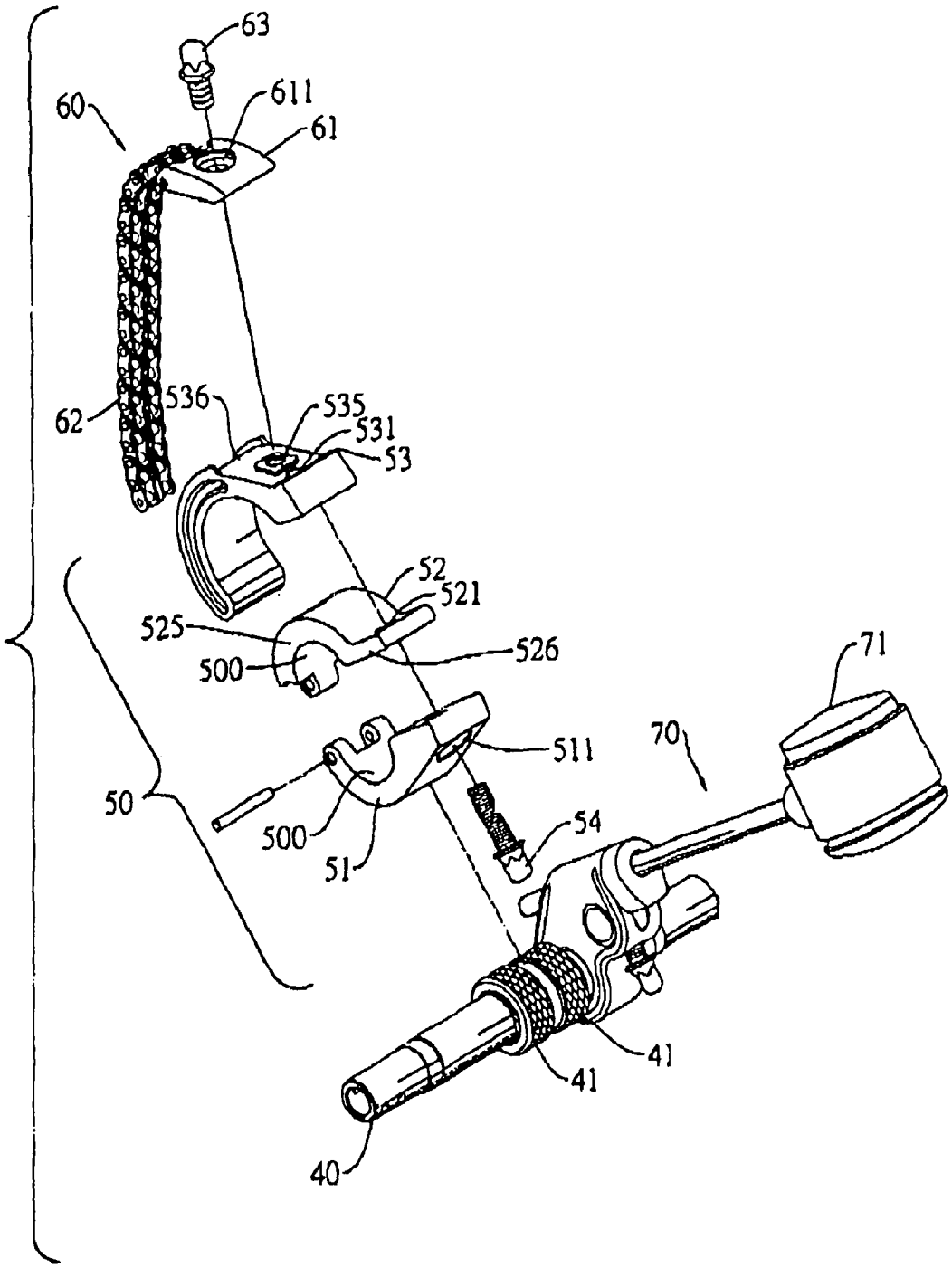
FIG. 4 is an enlarged exploded perspective view of a shaft, elevation-angle-adjusting assembly, chain assembly and beater of the musical instrument pedal in FIG. 3.
Figure 5:
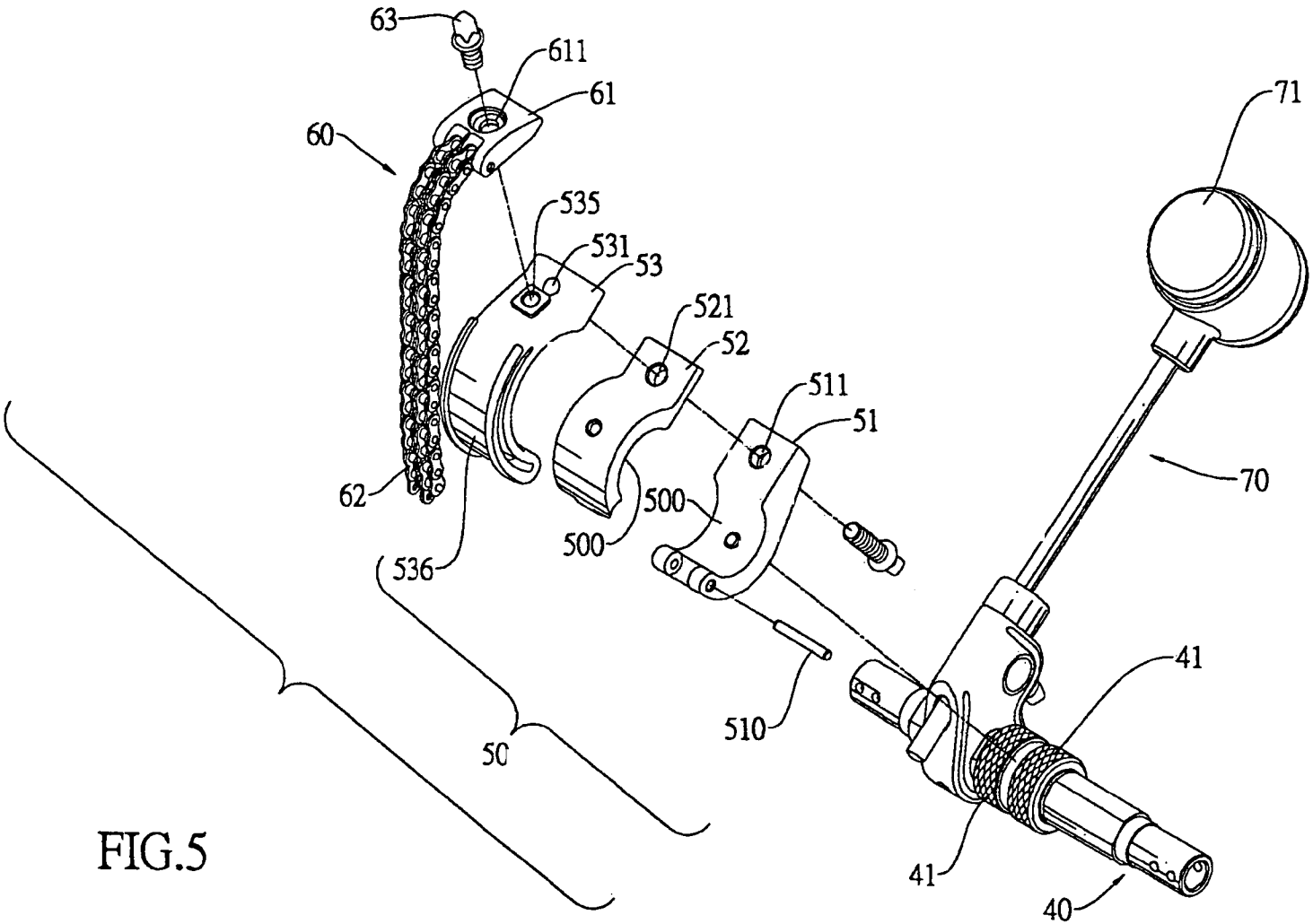
FIG. 5 is another enlarged exploded perspective view of the shaft, elevation-angle-adjusting assembly, chain assembly and beater of the musical instrument pedal in FIG. 4.

With further reference to FIGS. 4 and 5, the elevation-angle-adjusting assembly (50) is mounted detachably on the friction mount (41) of the shaft (40) and selectively changes an angle (or called rotational position) thereof relative to the shaft (40). The elevation-angle-adjusting assembly (50) has a lower clamping jaw (51), an upper clamping jaw (52) and a pad (53) and may further have an adjusting bolt (54).

The lower clamping jaw (51) may have a connecting end, a free end, a notch (500) and a mounting hole (511). The free end is defined opposite to the connecting end. The notch (500) is defined in the lower clamping jaw (51) and detachably engages the at least one friction mount (41) of the shaft (40). The mounting hole (511) is defined through the lower clamping jaw (51) near the free end.

Figure 6:
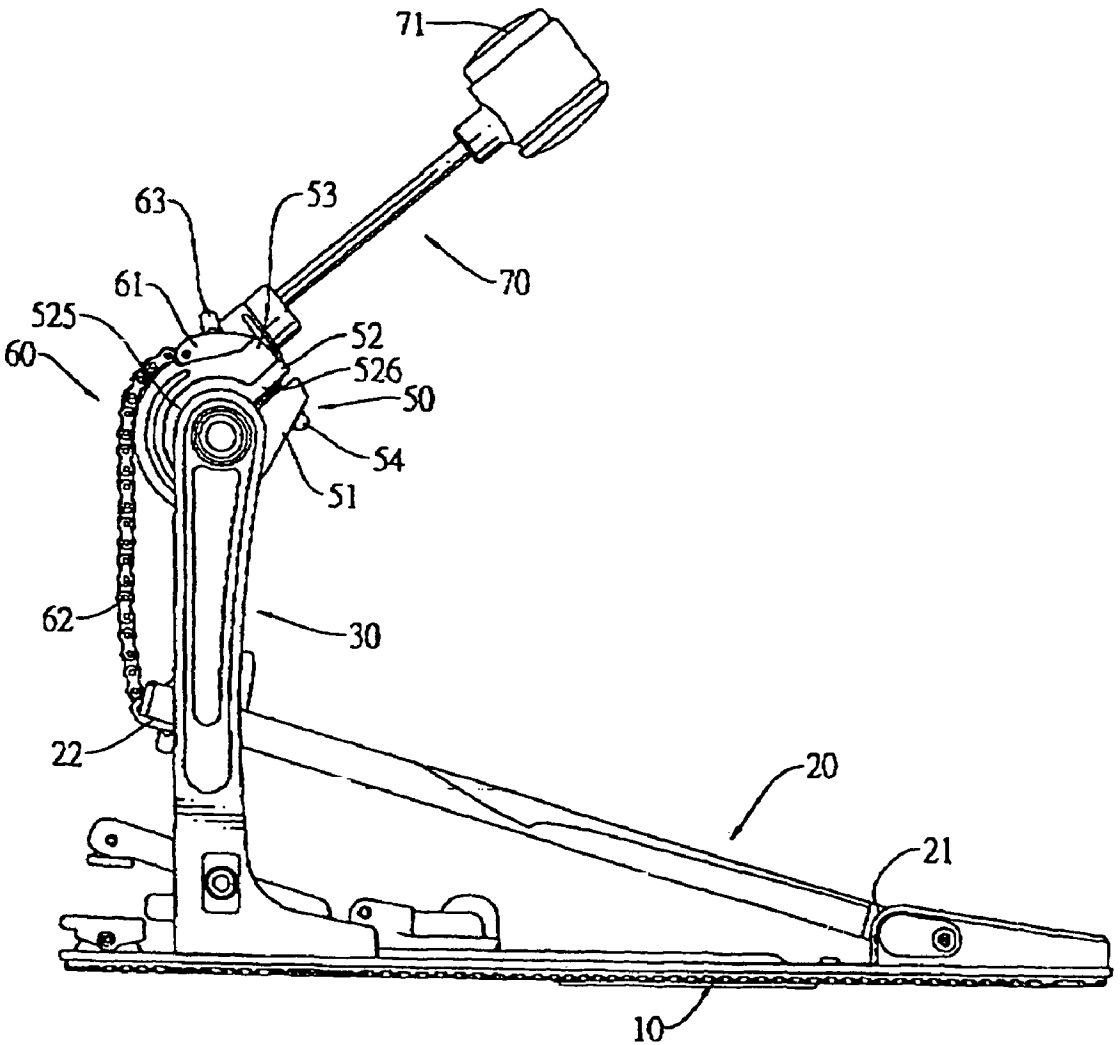
FIG. 6 is a side view of the musical instrument pedal in FIG. 1.

The upper clamping jaw (52) is connected to and cooperates with the lower clamping jaw (51) to detachably clamp the at least on friction mount (41) of the shaft (40) and may have a connecting end, a free end, a notch (500) and a fastening hole (521). Furthermore, the upper clamping jaw (52) is formed by a curved segment (525) and a flat tongue segment (526), as shown in FIGS. 4 and 6. The flat tongue segment (526) protrudes from the curved segment (525). The connecting end is connected pivotally to the connecting end of the lower clamping jaw (51). The free end is defined opposite to the connecting end. The notch (500) is defined in the upper clamping jaw (52) and detachably engages the at least one friction mount (41) of the shaft (40). The fastening hole (521) is defined through the flat tongue segment (526) of the upper clamping jaw (52) near the free end.

The pad (53) is mounted detachably on the upper clamping jaw (52) so that the flat tongue segment (526) of the upper clamping jaw (52) is located between the lower clamping jaw (51) and the pad (53). The pad (53) may have outer convex surface, a curved guide slot (536), a threaded hole (531) and a screwing hole (535). The curved guide slot (536) is defined in the outer convex surface. The threaded hole (531) is defined through the pad (53). The screwing hole (535) is defined through the pad (53).

The adjusting bolt (54) presses against the lower clamping jaw (51), is mounted through the mounting hole (511) of the lower clamping jaw (51) and the fastening hole (521) of the upper clamping jaw (52) and is screwed detachably in the threaded hole (531). Rotating the adjusting bolt (54) selectively tightens or loosens the elevation-angle-adjusting assembly (50) so that the angle of the elevation-angle-adjusting assembly (50) relative to the shaft (40) may be changed when loosened. Furthermore, the adjusting bolt (54) may be rotated through a hand tool such as a wrench.

The chain assembly (60) is connected to the fore end (22) of the pedal plate (20) and the elevation-angle-adjusting assembly (50) and has a fastener (61) and a chain (62) and may further have a fastening bolt (63).

The fastener (61) is mounted detachably on the pad (53) and may have a mounting bore (611) defined through the fastener (61).

The chain (62) may engage the curved guide slot (536) of the pad (53) to prevent inadvertently fall from the pad (53). The chain (42) has two ends. One end is mounted on the fastener (61) and the other end is mounted on the fore end (22) of the pedal plate (20). Therefore, stepping on the pedal plate (20) pulls the chain (42) and rotates the first shaft (40). Furthermore, The pad (53) further increases a circumference of the shaft (10) and thus magnifies length variation of the chain (42) when the user steps the pedal plate (20).

The fastening bolt (63) is mounted through the mounting bore (611) of the fastener (61) and is screwed detachably in the screwing hole (535) of the pad (53). Furthermore, the fastening bolt (63) may be rotated through a hand tool such as a wrench.

The beaters (70) are transversely mounted on the shaft (40). Each beater (70) may have a distal end and a striking head (71). The striking head (71) is mounted on the distal end and may strike a percussion instrument such as a bass drum.

Each of the at least one positioning assembly (80) is mounted on one supporting post (30), is connected to the shaft (40) to recover a rotational position of the shaft (40) relative to the supporting posts (30) and has a post mount, a sleeve and a spring.

The post mount is mounted securely on the supporting post (30).

The sleeve is mounted securely around the shaft (40).

The spring is connected between the post mount and sleeve (81) to provide resilient force so that the shaft (40) and the elevation-angle-adjusting assembly (50) rotates back to a same rotational position relative to the supporting posts (30) when no external force is applied to the pedal plate (20).

Figure 7:
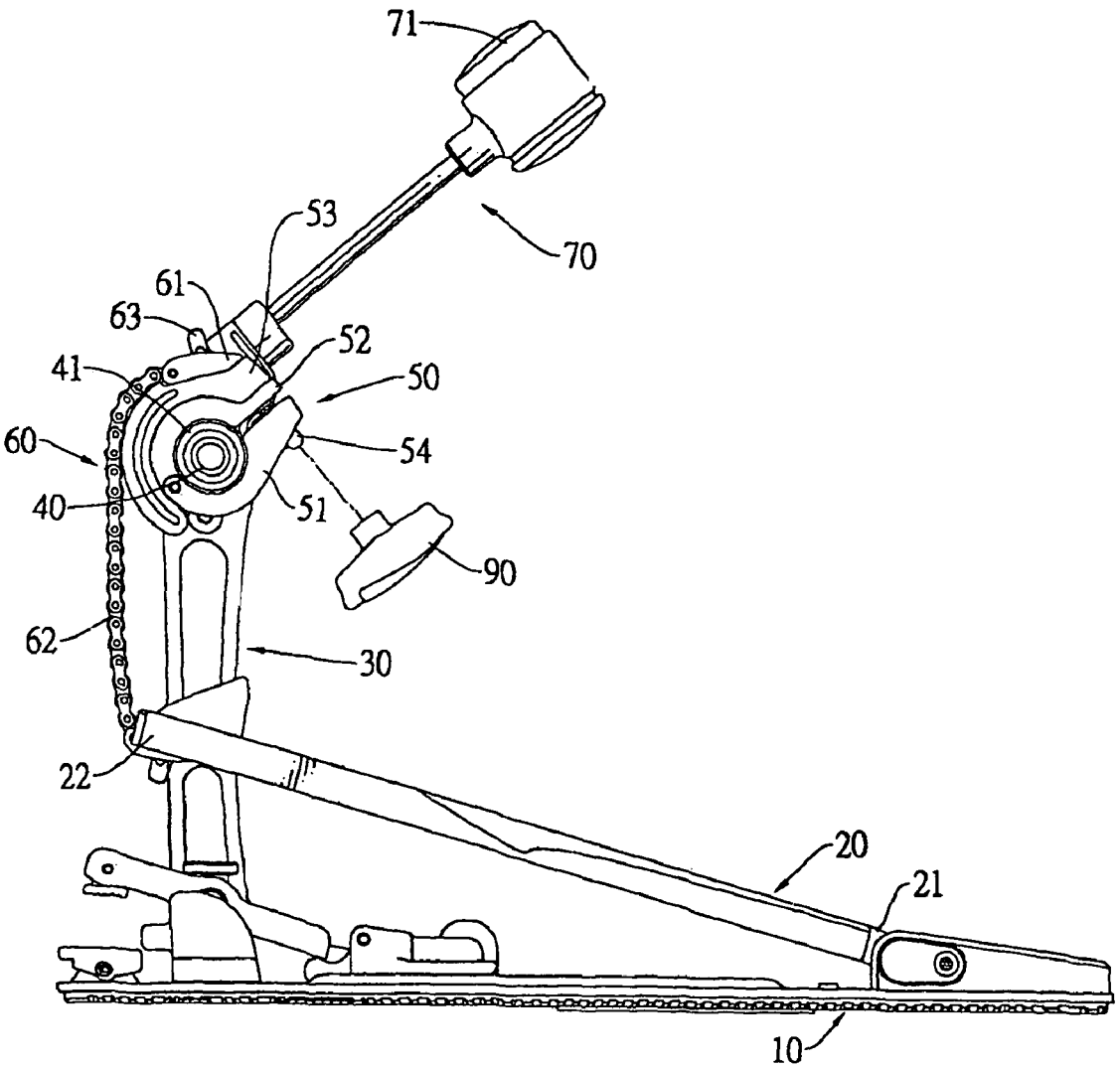
FIG. 7 is an operational side view of the musical instrument pedal in FIG. 6 showing that a hand tool is used to release the elevation-angle-adjusting assembly to adjust the elevation angle of the pedal plate.
Figure 8:
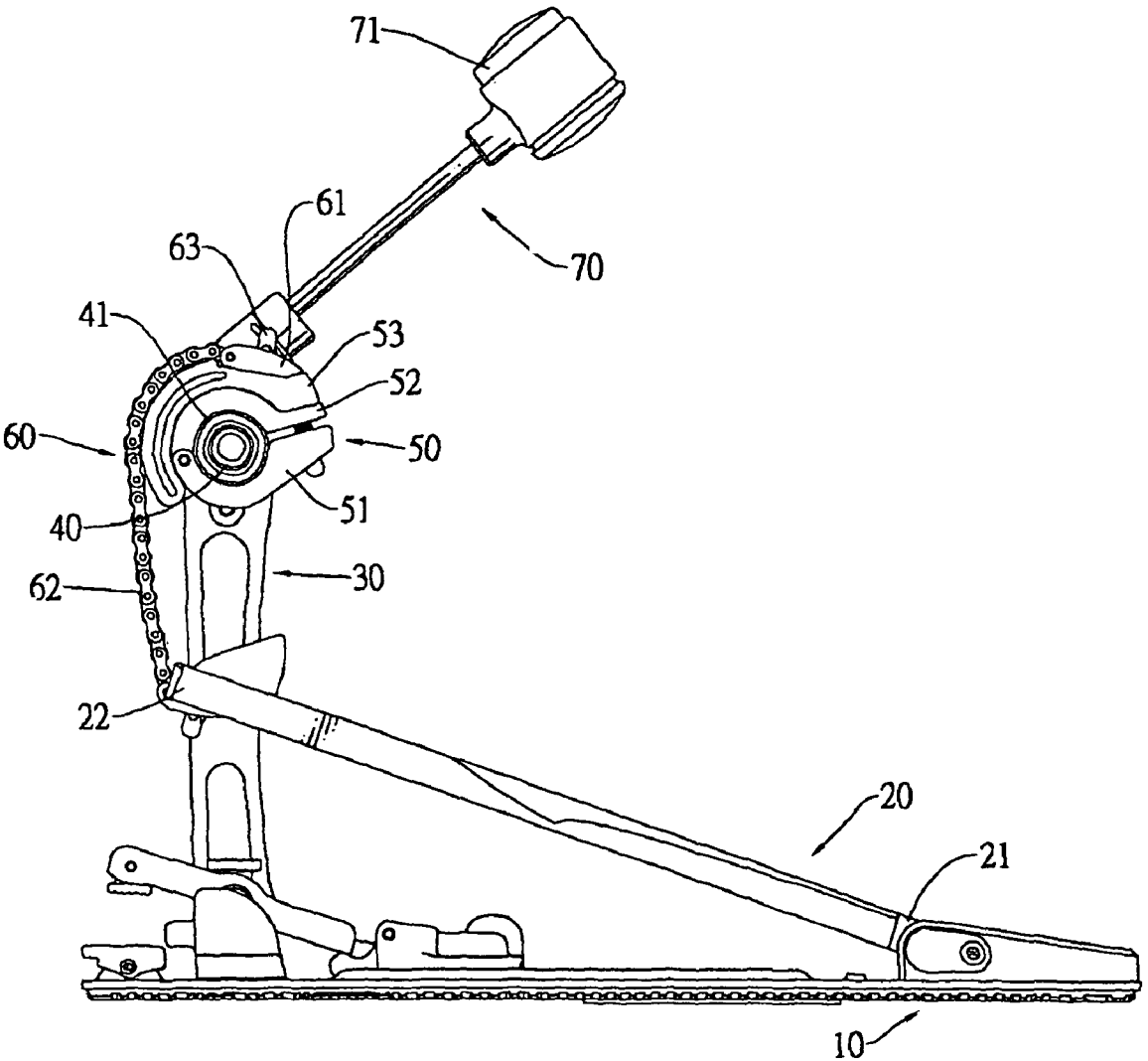
FIG. 8 is an operational side view of the musical instrument pedal in FIG. 7 showing that the elevation angle of the pedal plate is changed.

With further reference to FIGS. 6 to 8, the elevation-angle-adjusting assembly (50) detachably mounted on the friction mount (41) of the shaft (40) may be loosened by a hand tool (90) to change the angle thereof relative to the shaft (40) to further vary a height of the end of the chain (62) mounted on the fore end (22) of the pedal plate (20) relative to the base (10). Therefore, the elevation angle of the pedal plate (20) may be quickly adjusted for different users.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A musical instrument pedal comprising:

a base;

two supporting posts mounted uprightly on the base;

a pedal plate mounted on the base between the supporting posts and having a rear end mounted pivotally on the base; and a fore end defined opposite to the rear end and lifted over the base;

a shaft mounted rotatably on and between the supporting posts and having at least one friction ring mounted securely around the shaft;

an elevation-angle-adjusting assembly mounted detachably on the friction mount of the shaft, selectively changing an angle thereof relative to the shaft and having a lower clamping jaw having a mounting hole defined through the lower clamping jaw;

an upper clamping jaw connected to and cooperating with the lower clamping jaw to detachably clamp the at least one friction mount of the shaft, the upper clamping jaw being formed by a curved segment and a flat tongue segment protruding from the curved segment, the upper clamping jaw having a fastening hole defined through the flat tongue segment of the upper clamping jaw; and a pad mounted detachably on the upper clamping jaw so that the flat tongue segment of the upper clamping jaw is located between the lower clamping jaw and the pad, the pad having a threaded hole defined through the pad;

a chain assembly connected to the fore end of the pedal plate and the elevation-angle-adjusting assembly and having a fastener mounted detachably on the pad; and a chain having two ends, one end mounted on the fastener and the other end mounted on the fore end of the pedal plate; and two beaters mounted transversely on the shaft;

wherein an adjusting bolt presses against the lower clamping jaw, is mounted through the mounting hole of the lower clamping jaw and the fastening hole of the upper clamping jaw and is screwed detachably in the threaded hole of the pad.

2. The musical instrument pedal as claimed in claim 1, wherein the pad has an outer convex surface and a curved guide slot defined in the outer convex surface; and the chain engages the curved guide slot of the pad.

3. The musical instrument pedal as claimed in claim 2 further comprising at least one positioning assembly, wherein each of the at least one positioning assembly is mounted on one supporting post and is connected to the shaft to recover a rotational position of the shaft relative to the supporting posts.

4. The musical instrument pedal as claimed in claim 3, wherein the lower clamping jaw has a connecting end; and a free end defined opposite to the connecting end; and the upper clamping jaw has a connecting end connected pivotally to the connecting end of the lower clamping jaw; and a free end defined opposite to the connecting end of the upper clamping jaw.

5. The musical instrument pedal as claimed in claim 4, wherein the lower clamping jaw further has a notch defined in the lower clamping jaw and detachably engaging the at least one friction mount of the shaft; and the upper clamping jaw has a notch defined in the upper clamping jaw and detachably engaging the at least one friction mount of the shaft.

6. The musical instrument pedal as claimed in claim 5 wherein the pad further has a screwing hole defined through the pad;

the fastener of the chain assembly has a mounting bore defined through the fastener; and a fastening bolt is mounted through the mounting bore of the fastener and screwed detachably in the screwing hole of the pad.

7. The musical instrument pedal as claimed in claim 6, wherein each of the at least one friction ring has an outer surface and a friction texture formed on the outer surface.

* * * * *